United States Patent [19]

Vujovich

[11] Patent Number: 4,826,042

[45] Date of Patent: May 2, 1989

[54] BLADE HOLDER AND AUTOMATIC DISPENSER

[75] Inventor: Nick Vujovich, Devon, Pa.

[73] Assignee: Le-Jo Enterprises, Inc., Malvern, Pa.

[21] Appl. No.: 95,553

[22] Filed: Sep. 11, 1987

Related U.S. Application Data

[63] Continuation-in-part of Ser. No. 50,067, May 13, 1987.

[51] Int. Cl.[4] ..... B65H 1/08

[52] U.S. Cl. ..... 221/228; 221/232; 221/257; 221/279; 206/208; 206/355

[58] Field of Search ..... 221/232, 257, 255, 309, 221/240, 229, 135, 226, 228, 280, 58, 59, 56, 45, 271, 52, 57, 198, 276, 279, 244; 206/208, 355–358; 312/61, 71; 211/59.3

[56] References Cited

U.S. PATENT DOCUMENTS

| | | | |
|---|---|---|---|
| 489,069 | 1/1893 | Crook | 221/232 |
| 1,218,196 | 3/1917 | McCorkindale | 221/58 X |
| 1,791,586 | 2/1931 | Todd | 221/232 X |
| 1,911,627 | 5/1933 | Lashar | 221/240 X |
| 2,094,722 | 10/1937 | Sandford | 221/240 X |
| 2,326,202 | 8/1943 | Bryan | 221/240 |
| 2,363,908 | 11/1944 | Stampleman | 221/232 |
| 2,589,722 | 3/1952 | Mead | 221/232 |
| 2,641,358 | 6/1953 | Santo | 221/232 |
| 2,748,979 | 6/1956 | Szekely | 221/229 |
| 2,775,366 | 12/1956 | Willhelm | 221/232 |
| 3,071,290 | 1/1963 | Taylor | 221/59 |
| 3,202,316 | 8/1965 | Silver | 221/59 |
| 3,244,317 | 4/1966 | Raybin | 221/240 X |
| 3,650,433 | 3/1972 | Robertson | 221/65 |
| 4,379,514 | 4/1983 | Joffe | 221/279 |

*Primary Examiner*—Joseph J. Rolla
*Assistant Examiner*—S. B. Parker
*Attorney, Agent, or Firm*—Benasutti & Murray

[57] ABSTRACT

The present invention includes a holder for blades having a dispensing opening through which a single blade can be slideably ejected by either a sliding ejector or manual manipulation through a thumb slot. The blades within the holder are aligned by a free floating partition which is biased toward the dispensing opening by at least one rubber band formed in a double loop configuration. The double loop configuration orients the rubber band such that it loops around the back of the holder, loops adjacent the front of the holder, and loops around the back of the sliding partition. The ejector includes an extension to occlude the edge of a dispensed blade.

10 Claims, 4 Drawing Sheets

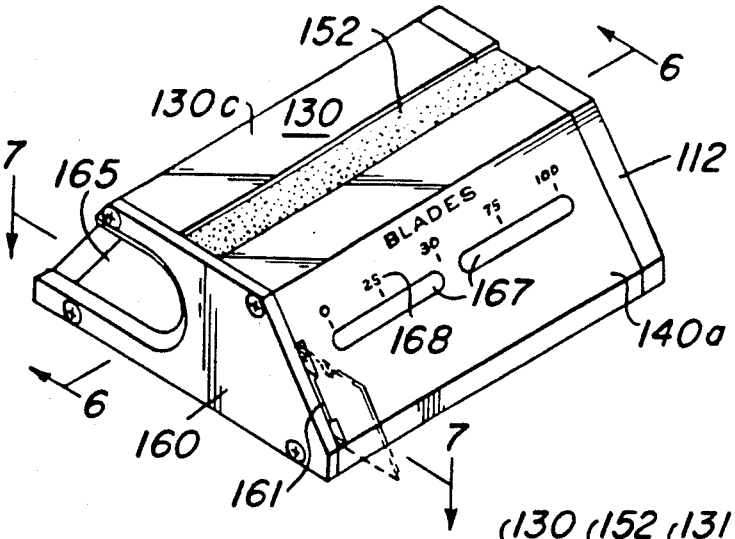
FIG. 5
FIG. 6
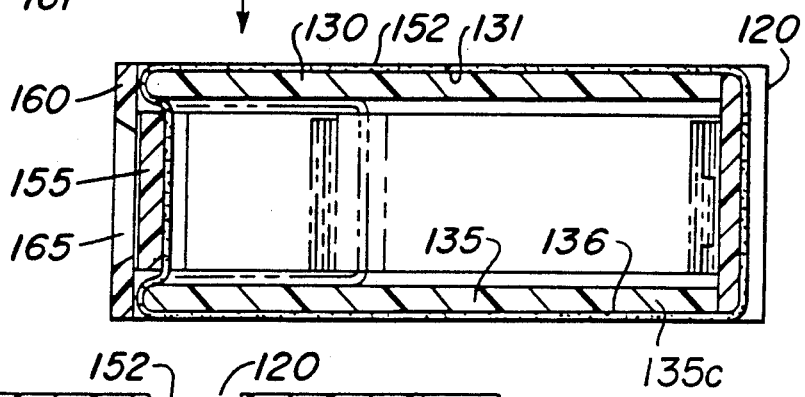
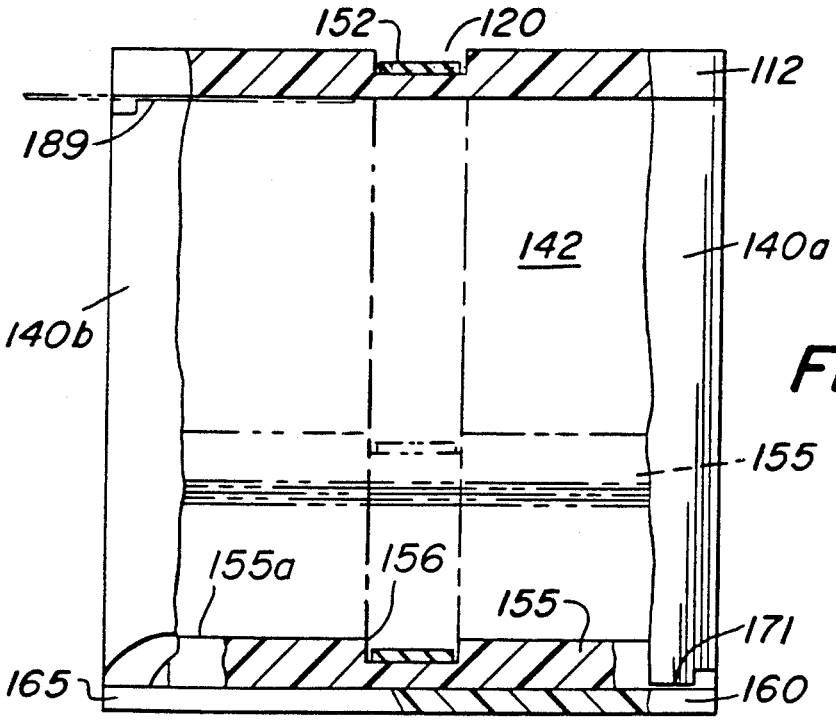
FIG. 7

BLADE HOLDER AND AUTOMATIC DISPENSER

This is a continuation in part of application Ser. No. 050,067, filed May 13, 1987.

BACKGROUND OF THE INVENTION

The present invention is directed to a holder and dispenser for blades and more particularly to a utility knife blade holder and dispenser which employs a looped rubber band to bias the blades toward the dispenser opening.

In industry, as well as many household activities such as hobbies and crafts, replaceable blades are employed for a wide variety of tasks. For example, replaceable utility knife blades are used in cutting carpeting, cardboard, dry wall sheets, plastic and other materials. The blades dull quickly and must be replaced often to provide a sharp cutting edge. Replacement blades, having a highly sharpened cutting edge are dangerous to handle. A holder and dispenser which ejects a single blade at a time is desirable to both protect the edge on the blades and minimize handling of the blades. A typical utility knife blade is a metal, trapezoidal shaped blade with the longest edge the cutting edge and including notches on the shorter back of the blade. Other blade configurations such as single-edged razor blades and utility blades with a hook-shaped cutting edge are known.

Holders and dispensers for such blades are known. For example, U.S. Pat. Nos. 3,827,597 and 3,542,245 disclose utility knife blade dispensers which use springs to bias the blades toward a dispenser which pivots in the plane of the blades to be dispensed to expose a blade. U.S. Pat. No. 3,650,433 discloses a blade dispenser in which a cover slides over a blade supporting base to hold the blades in a position to be dispensed by sliding through an aperture in the cover. U.S. Pat. No. 4,379,514 discloses a blade holder and dispenser which uses a manual, ratcheting, sliding follower to hold blades in position against a thumb slot which allows blades to be pushed through a dispensing opening. U.S. Pat. Nos. 3,767,083; 2,641,358 and 1,908,115 disclose holders for razor blades which include springs to bias the blades toward a dispensing opening through which the blades are pushed.

It is an object of the present invention to provide a blade holder and dispenser which employs a rubber band to bias blades toward a dispensing opening.

It is a further object of the present invention to provide a blade holder and dispenser which employs a rubber band formed into a double loop configuration to bias blades toward a dispensing opening.

It is a further object of the present invention to provide a blade holder and dispenser which orients a double looped rubber band in slots to protect the looped rubber band from the cutting edge of the blades to be dispensed.

It is a further object of the present invention to provide a blade holder and dispenser which protects the user from the sharp edge of the blade during blade dispensing.

SUMMARY OF THE INVENTION

The present invention includes a holder for blades having a dispensing opening through which a single blade can be ejected such as by a sliding ejector. The blades within the holder are aligned with a sliding partition which is biased toward the dispensing opening. The sliding partition is biased by an elastomeric member which is looped around the back of the holder and also around the back of the sliding partition. Thus, the biasing forces are applied to the sliding partition. This allows the sliding partition to be self or automatically adjusted or oriented in the holder due to the self-adjusting or equalizing biasing force applied by the elastomeric member. The biasing of the blades toward the dispensing opening allows the blades to be dispensed regardless of dispenser orientation. This allow the user to see the blade being dispensed rather than inverting the dispenser so that gravity will pull a blade toward the dispensing opening. The holder and sliding partition include slots or grooves into which the elastomeric member fits to protect the member from the sharp edges of the blades. The blades are preferably pushed from the dispensor by a sliding ejector which may include a protecting extention to sheild the user from the sharp edge of the blade.

BRIEF DESCRIPTION OF THE DRAWING

FIG. 5 is an isometric view of an alternate embodiment of my present invention.

FIG. 6 is a cross-section taken along line 6—6 of FIG. 5.

FIG. 7 is a cross-section taken along line 7—7 of FIG. 5.

DETAILED DESCRIPTION OF THE PREFERRED EMBODIMENT

Figure 1:
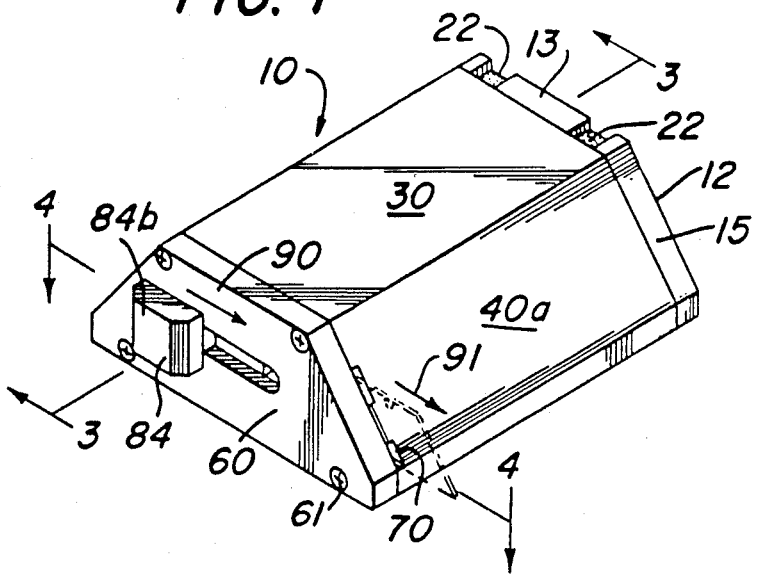
FIG. 1 is an isometric view of my present invention.

With reference to the drawings, a first embodiment of my present invention is shown in FIGS. 1 through 4. The blade holder and dispenser is designated generally 10 and is adapted for holding and dispensing trapezoidal utility blades. The blade holder and dispenser includes a rear wall 12. Rear wall 12 is of a trapezoidal configuration having a top 13, a bottom 14 and sloping sides 15 and 16. Rear wall 12 has formed on a surface 12*a* thereof two parallel slots 18 and 20. Slots 18 and 20 extend from the top 13 to bottom 14. Slots 18 and 20 terminate at notches 22 which extend from slots 18 and 20 to surface 12*b* of rear wall 12. Extending substantially perpendicularly from rear wall 12 are top 30, bottom 40 and sides 40*a* and 40*b*. The rear wall 12, top 30, bottom 35 and sides 40*a* and 40*b* define a cavity 42 having the general cross-sectional shape and dimensions of the blade to be dispensed, in the drawings a trapezoid. Alternatively, one of the sides 40*a* or 40*b* may include sight openings to allow the user to see how many blades are held in the holder.

Oriented interior surface 30*a* of top 30 are parallel grooves 31. The grooves 31 are oriented so as to align with slots 18 and 20 and notches 22 of rear wall 12. Grooves 31 extend longitudinally for the length of top 30. Oriented on the interior surface 35*a* of bottom 35 are parallel grooves 36. The grooves 36 are oriented so as to align with slots 18 and 20 and notches 22 of rear wall 12.

Grooves 36 extend longitudinally for the length of bottom 35.

Figure 2:
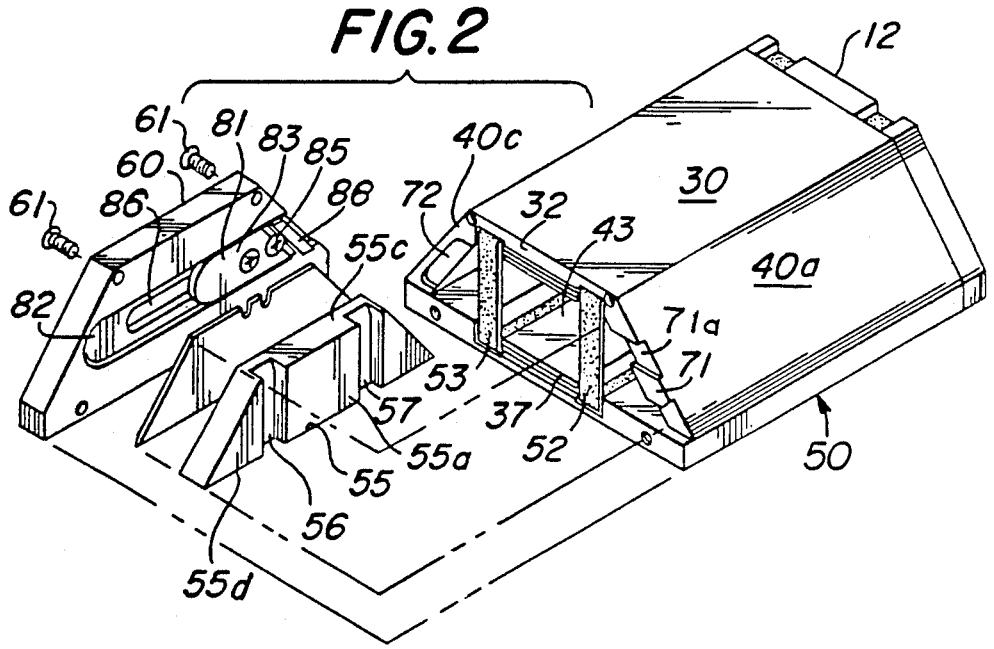
FIG. 2 is an exploded isometric view of my present invention.
Figure 3:
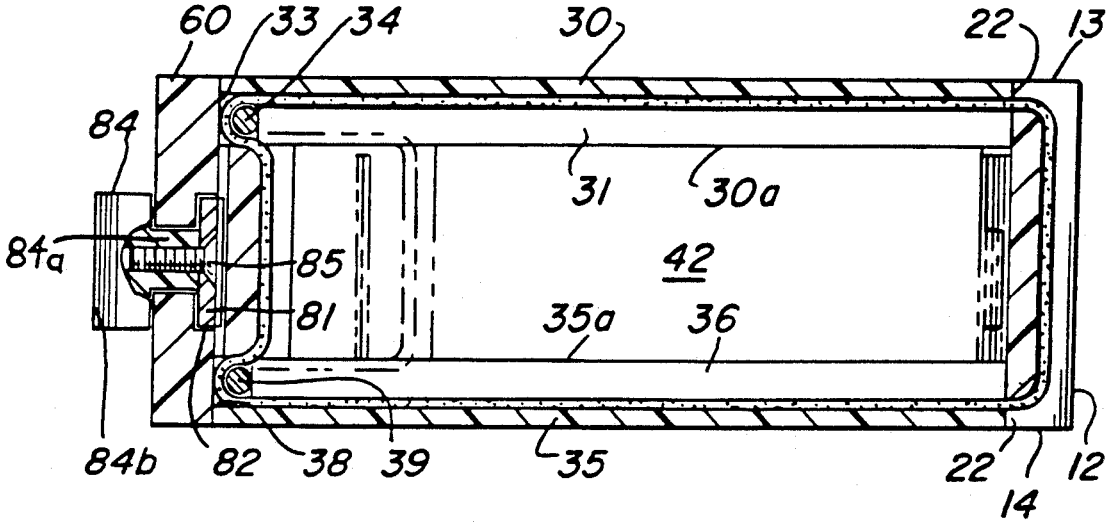
FIG. 3 is a cross-section taken along line 3—3 of FIG. 1.
Figure 4:
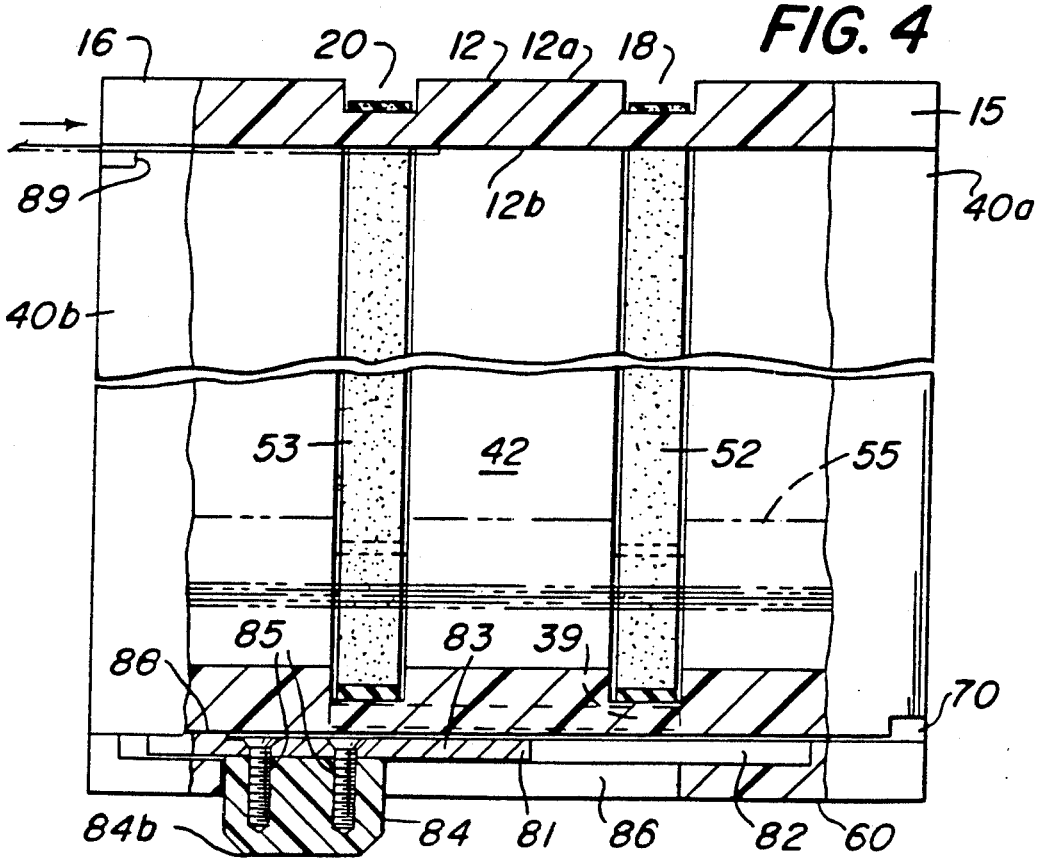
FIG. 4 is a cross-section taken along line 4—4 of FIG. 1.

On the front end 32 of top 30, extending between grooves 31 is a hollow 33 adapted to receive a first roller 34 which extends between grooves 31. The front end 37 of bottom 35, includes a hollow 38 extending between grooves 36, adapted to receive a second roller 39 which extends between grooves 36. Top 30, bottom 35 and sides 40*a* and 40*b* forming body 50 may be formed from a single piece as by molding or may be separate elements interconnected by any suitable means such as screws or glue. Rear wall 12 is a separate piece adapted to be affixed to body 50 by any suitable means such as screws or glue. Rear wall 12 is formed as a separate piece to allow rubber bands 52 and 53 to be oriented around rear wall 12 in slots 18 and 20, through notches 22, along grooves 31 and 36 and around rollers 34 and 39 as shown in FIGS. 2, 3 and 4. The rubber bands 52 and 53 are thus looped around rear wall 12 and rollers 34 and 39 and extend across the front opening 43 of cavity 42.

A sliding partition 55 is provided which fits within cavity 42 and may be of the general cross-sectional shape of the blades to be held in cavity 42. Sliding partition 55 is of a size and shape so that it is free floating within cavity 42, that is there is no interconnection between sliding partition 55 and the walls of cavity 42. Sliding partition 55 includes grooves 56 and 57 on a back surface 55*a* which are adapted to receive rubber bands 52 and 53 when sliding partition 55 is oriented within cavity 42. The rubber bands 52 and 53 are thus formed into loops around rollers 34 and 39 and the back side 55*a* of partition 55. The looped rubber bands 52 and 53 bias partition 55 toward the opening 43 of cavity 42. The looped rubber bands contact the sliding partition 55 at both the top 55*c* and bottom 55*d* and along grooves 56 and 57 of sliding partition to provide for a multipoint or area contact of the biasing force on sliding partition 55. Sliding partition 55 is thus aligned or oriented within cavity 42 by the equalizing or self-adjusting biasing action of rubber bands 52 and 53.

A front cover 60 is provided which is releasably affixed to the front distal ends of top 30, bottom 35 and sides 40*a* and 40*b* to enclose cavity 42. Front cover 60 is fixed by screws 61 or other suitable means. Before front cover 60 is fixed in position, sliding partition 55 is oriented in cavity 42 in contact with rubber bands 52 and 53 and a plurality (typically 100) blades are inserted into cavity 42 so as to force partition 55 toward back wall 12 as shown in phantom in FIGS. 3 and 4. The cover 60 is then fixed in place. The blades held in cavity 42 are thereby biased towards front cover 60 by the looped rubber bands 52 and 53 which bias the sliding partition 55.

Front cover 60 includes an ejector means to slide a single blade out of the holder 10 through dispensing opening 70. Dispensing opening 70 is formed between front cover 60 and a first side 40*a* as by forming a notch 71 in side 40*a*. The notch is of a depth of from about 0.02 to 0.03 inches to allow blades of standard thicknesses of from about 0.012 to 0.025 inches to easily slide between front cover 60 and side 40*a*. Notch 71 can also include openings 71*a* to allow a thicker, reinforced section of a blade, as with the back of single edged razor blade to pass. On the distal end 40*c* of second side 40*b*, a notch 72 is formed to allow extending lip 88 of ejector 80 described below to fit therein.

Ejector 80 includes a sliding plate 81 oriented in a groove 82 in front cover 60. Sliding plate 81 has a main body portion 83 which fits within groove 82 and is of a thickness slightly less than the depth of groove 42. Plate 81 is held ingroove 82 by attachment to knob 84 by screws 85 or other suitable means. A portion 84*a* of knob 84 having a reduced cross sectional area extends through a slot 86 in front wall 60 which corresponds to groove 82. The exposed portion 84*b* of knob 84 thus can be used to slide plate 81 laterally across front cover 60.

An extending lip 88 of plate 81 is provided to engage one of the blades held in cavity 42 which are biased against front wall 60 by sliding partition 55 and looped rubber bands 52 and 53. As plate 81 is moved laterally, arrow 90, a single blade is engaged by lip 88 and slid laterally, arrow 91, to be ejected through dispensing opening 70. As plate 81 is moved back, lip 88 of plate 81 fits into notch 72 on side 40*b* so that the next blade can be biased against front cover 60 for ejection.

If desired, the holder 10 may also include a notch 89 between second side 40*b* and rear wall 12 to allow used blades to be inserted into cavity 42 behind sliding partition 55, FIG. 4.

With references to FIGS. 5, 6 and 7, an alternate embodiment of my present invention is shown. In the alternate embodiment, a single rubber band 152 is oriented in a groove 120 of back wall 112 and grooves 131 and 136 of top 130 and bottom 135 respectively. The grooves 131 and 136 are on the exterior surfaces 130*c* and 135*c* of top 130 and bottom 135 respectively. The rubber band 152 thus extends across the front opening 143 of cavity 142 from top 130 to bottom 135. A sliding partition 155 having a slot 156 on a rear surface 155*a* is fitted within cavity 142. Rubber band 152 fits within slot 156 so that rubber band 152 is looped behind sliding partition 155 so as to bias sliding partition toward the front cover 160. Front cover 160 includes a thumb slot 165 which allows a blade (shown in phantom in FIGS. 6 and 7) to be pushed laterally through dispensing opening 171. Dispensing opening 171 is formed between side 140*a* and front cover 160.

If desired, side 140*a* may include sight openings 167 and markings 168 so that the number of blades in the holder 110 can be monitored. A slot 189 may be provided between side 140*b* and rear wall 112 to allow used blades to be inserted into cavity 142 behind sliding partition 155 for disposal.

Figure 8:
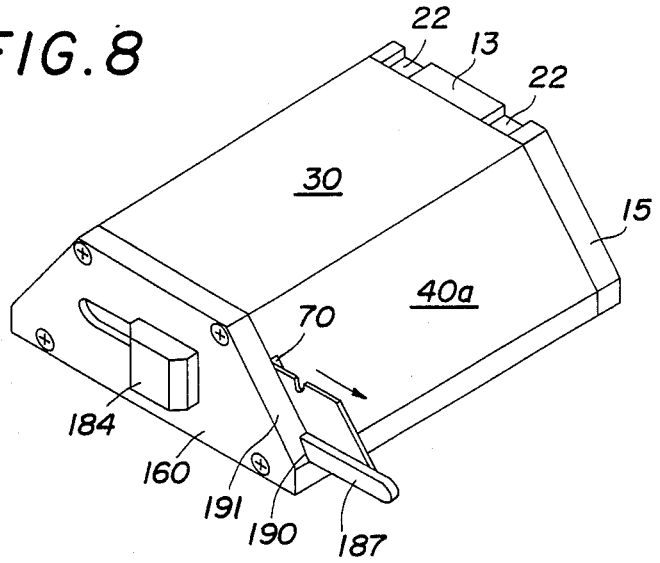
FIG. 8 is an isometric view of an alternate embodiment of my present invention.
Figure 9:
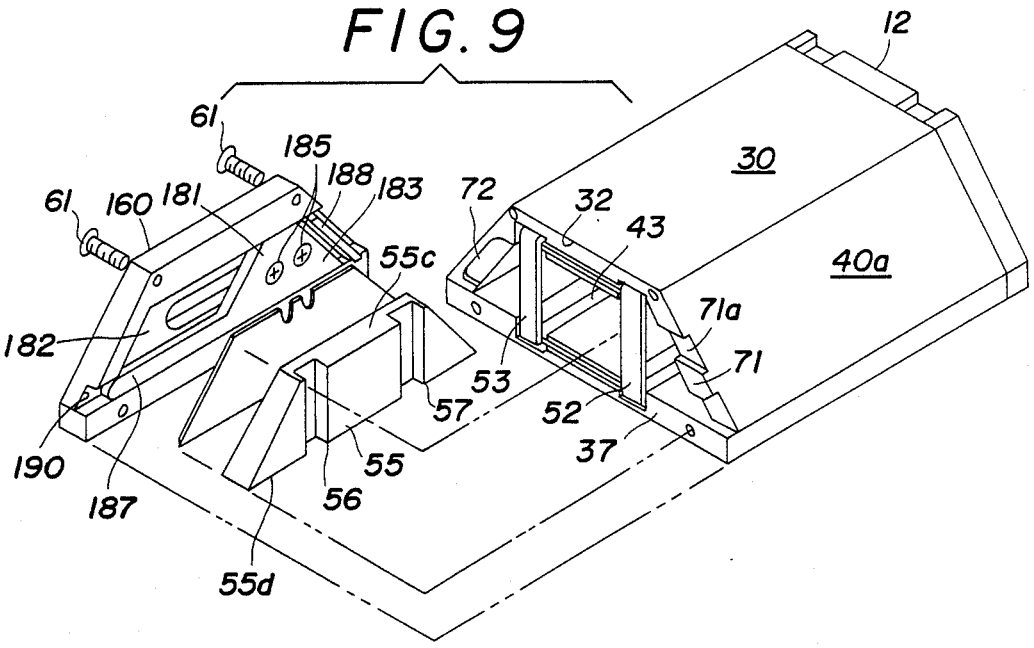
FIG. 9 is an exploded isometric view of the alternate embodiment of FIG. 8.

With reference to FIGS. 8 and 9, an alternate embodiment of my present invention is shown. In the alternate embodiment, sliding plate 81 of ejector 80 is replaced with a safety sliding plate 181. Safety sliding plate 181 includes a main body portion 183 which fits within groove 182 of cover 160. Body portion 183 is of a thickness slightly less than the depth of groove 182. Plate 181 is held in groove 182 by attachments to a knob 184 by screws 185 or other suitable means. If desired, knob 184 may be counter sunk in a slot in cover 160 (not shown).

Plate 181 includes a safety extension 187 which extends from plate 181 opposite lip 188. Extension 187 is oriented in a slit 190 in cover 160 which extends from groove 182 to edge 191 of cover 160. As a blade is ejected through dispensing opening 170 by plate 181 extension 187 covers the sharp edge and point of the blade being dispensed to protect the user. FIG. 8.

The apparatus of the present invention provides a blade holder and dispenser which uses rubber bands formed into a double loop configuration to bias a sliding partition in a blade holder toward the blade ejection means. The rubber bands are protected by orientation within grooves in the body of the holder. The double loop configuration of the rubber bands provides an optimized biasing force which maintains adequate pressure on the blades even as the stack of blades in the holder is depleted. The maintenance of pressure on the blades within the holder and dispenser by the double loop configuration of the rubber bands also prevents the next blade to be dispensed from falling out of the holder and dispenser during handling due to the maintenance of biasing pressure on the stack of blades regardless of the number of blades in the stack. This biasing of the stack of blades in the holder against the front cover of the holder dispenser further allows the use of the holder and dispenser with different blade thicknesses. Because the stack of blades in the holder dispenser is continually biased against the front cover by the double loop configuration of the rubber bands, blades of differing thicknesses can be used in a single holder and dispenser without the next blade to be dispensed falling through the dispensing opening.

Although the foregoing serves well to satisfy the objectives previously set forth, it will be understood that the blade holder and dispenser previously described may be modified in order to be employed with a variety of blade designs. For example, the size and cross-sectional shape of the blade holder and dispenser may be modified so as to be particularly suitable for holding and dispensing rectangularly shaped single edge razor blades, or other blade shapes.

It will therefore be understood that various changes in the details, materials and arrangement of the parts which have been herein described and illustrated in order to explain the nature of this invention, may be made by those skilled in the art within the principal and scope of the invention as expressed in the following claims.

What is claimed is:

1. Holder and dispenser for blades comprising:

(a) rear wall;

(b) top, bottom and sides extending from said rear wall defining a longitudinal cavity;

(c) a sliding partition adapted to fit in said cavity;

(d) a front cover adapted to seal said cavity and having means to slide blades laterally through a discharge slot including means to occlude the edge of the blades;

located on one of said sides, said means to slide blades laterally (e) at least one rubber band loope around said rear wall, which extends along the top and the bottom, is looped adjacent said front cover, and looped around a backside of said sliding partition.

2. The holder and dispenser of claim 1, wherein said means to dispense blades includes an ejector affixed to said cover, said ejector having a lip extending therefrom to engage a blade held in said cavity and also having extending therefrom means to occlude a blade edge, said blades baised toward said ejector by said rubber band acting on said sliding partition whereby sliding said ejector forces a blade out of said cavity through said discharge slot with said occluding means adjacent to the blade edge.

3. The holder and dispenser of claim 1, wherein said means to occlude the blade edges extends substantially beyond a discharged end of a blade.

4. An improved blade holder and dispenser for blades having a sharp edge, the blade holder and dispenser having a blade retaining cavity in which blades are biased towards an ejection means adjacent a discharge slot located on a side of said holder wherein the improvements comprises: at least one rubber band which contacts a free floating sliding partition, oriented in said cavity, at more than one point to bias blades towards said ejection means wherein the rubber band is arranged in a double loop configuration by orienting the rubber band around a back of said holder, looped adjacent a front of said holder and looped around a backside of said partition, the ejection means having safety means to occlude said sharp edge during ejection.

5. The improved holder and dispenser of claim 4 wherein said at least one rubber band is oriented in grooves formed in the holder and the sliding partition.

6. The improved holder and dispenser of claim 4, wherein said at least one rubber band is looped around rollers set in said holder adjacent said front.

7. The improved holder and dispenser of claim 4, wherein said at least one rubber band comprises two rubber bands.

8. The improved holder and dispenser of claim 4, wherein said ejection means comprises an ejector, slidingly affixed to the front cover of said holder, having a lip extending therefrom to engage a blade held in said cavity and having extending therefrom safety means to occlude said blade edge, said blade biased towards said ejection means by said biasing means whereby sliding said ejection means forces a blade out of said cavity through said discharge slot with the blade edge occluded by said safety means.

9. The improved blade holder and dispenser of claim 8, wherein said safety means comprises a blade edge protecting extension extending from said ejector to occlude said blade edge as said blade is ejected from said discharge slot.

10. The improved blade holder and dispenser of claim 9, wherein said protecting extension extends substantially beyond a discharged end of said blade edge.

* * * * *

UNITED STATES PATENT AND TRADEMARK OFFICE

CERTIFICATE OF CORRECTION

PATENT NO. : 4,826,042

DATED : May 2, 1989

INVENTOR(S) : Nick Vujovich

It is certified that error appears in the above-identified patent and that said Letters Patent is hereby corrected as shown below:

In the Claims

At Column 5, line 48, after "slot", please insert --located on one of said sides, said means to slide blades laterally--.

At Column 5, line 50-51, please delete [located on one of said sides, said means to slide blades laterally].

At Column 6, line 2, after "ejector", please insert --slidingly--.

Signed and Sealed this

Twelfth Day of March, 1991

*Attest:*

HARRY F. MANBECK, JR.

*Attesting Officer*

*Commissioner of Patents and Trademarks*